United States Patent [19]

Sard

[11] 4,358,861

[45] Nov. 16, 1982

[54] DRAINPIPE CLEANER

[76] Inventor: Juan A. Sard, 41-83 Frame Pl., Flushing, N.Y. 11355

[21] Appl. No.: 208,771

[22] Filed: Nov. 20, 1980

[51] Int. Cl.[3] ..... B08B 9/02; E03D 11/00

[52] U.S. Cl. ..... 4/255; 15/104.18; 15/104.3 R

[58] Field of Search ..... 15/104.16, 104.18, 104.3 R, 15/104.05, 341; 134/24; 417/555

[56] References Cited

U.S. PATENT DOCUMENTS

| | | | |
|---|---|---|---|
| 126,604 | 5/1872 | Wilder | 417/555 X |
| 1,821,900 | 9/1931 | Silvers | 4/255 X |
| 2,220,645 | 11/1940 | Girerd | 417/555 |
| 2,267,064 | 12/1941 | Wikelund | 4/255 |
| 2,577,417 | 12/1951 | Halpin | 417/555 |
| 2,608,695 | 9/1952 | Skibowski | 4/255 |
| 4,118,152 | 10/1978 | Bron | 417/555 |

*Primary Examiner*—Edward L. Roberts
*Attorney, Agent, or Firm*—Karl F. Ross

[57] ABSTRACT

An implement for dislodging lumps of matter clogging a drainpipe comprises a long handle with a resilient cup attached to its lower end, the cup having several slits that extend from its rim down to form a plurality of petal-shaped leaves which yield inward when the cup is thrust from above into the pipe but which hug the pipe wall on being pulled up. On being vertically reciprocated inside the drainpipe, the cup thus acts as a pump drawing up water and dissolving the obstruction.

5 Claims, 3 Drawing Figures

DRAINPIPE CLEANER

FIELD OF THE INVENTION

My present invention relates to an implement for dislodging obstructions in a drainpipe, especially lumps of matter at a location beyond a gooseneck which is not readily accessible from the entrance end of the pipe.

BACKGROUND OF THE INVENTION

Various devices have already been proposed for the cleaning of waste pipes or drains. U.S. Pat. No. 1,312,404, for example, describes a rod terminating at its lower end in a corkscrew-shaped member supporting a collar to which a plurality of links resembling the struts of an umbrella frame are articulated. U.S. Pat. No. 2,255,914 shows a train of scraper units with resilient arms, held together by a flexible core. Danish Pat. No. 41,271 teaches the use of a closed-bottom bell at the lower end of a tubular shaft, a rod movable in that shaft carrying a ring adapted to open or close two lateral apertures near the bottom of the bell which therefore forms a receptacle for mud to be lifted to the surface.

As far as I am aware, however, the only prior-art tools able to reach and remove matter clogging a relatively inaccessible part of a convoluted pipe are the rather unhandy snaking wires used by plumbers for this purpose.

OBJECT OF THE INVENTION

The object of my present invention, therefore, is to provide a simple and easy-to-handle implement for the purpose described.

SUMMARY OF THE INVENTION

The implement according to my invention comprises an elongate handle to whose lower end an upwardly open cup is secured. This cup is sufficiently flexible to yield inward upon being thrust down a water-filled pipe which has an inner diameter substantially equal to the outer diameter of the cup rim. When the cup is pulled up, the rim closely hugs the pipe wall under the weight of the water accumulated therein so as effectively to act as a suction pump tending to aspirate the obstructing matter.

To enhance the flexibility of the rim and its adaptability to the inner pipe surface, I prefer to provide the cup with slits extending from the rim down and dividing its periphery into a plurality of petal-shaped leaves which tend to diverge upwardly under the weight of the accumulated water and, thanks to their relative mobility, allow the implement to be used with a variety of pipe diameters. I have found that the exerted suction will not significantly diminish even when the leaves are fairly well separated, provided the cup is pulled up fast enough.

BRIEF DESCRIPTION OF THE DRAWING

The above and other features of my invention will now be described in detail with reference to the accompanying drawing in which.

SPECIFIC DESCRIPTION

Figure 1:
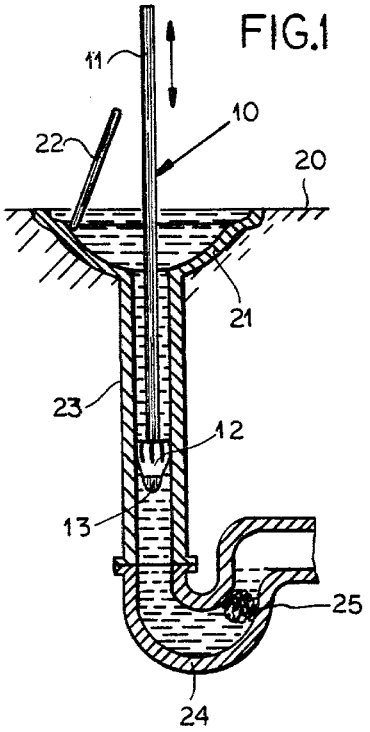
FIG. 1 is a sectional view of a clogged drainpipe in the process of being cleaned with the aid of an implement embodying my invention.

In FIG. 1 I have shown a floor 20 with a drain 21 from which a pipe 23 extends downward to carry accumulating water to a nonillustrated sewer, the pipe terminating at a gooseneck 24 shown to be clogged by a lump of matter 25 which is difficult to reach from the drain 21. The latter is normally overlain by a grate 22 which has been lifted up to enable the insertion of an implement 10 according to my invention. This implement comprises a long rod-shaped handle 11 carrying at its lower end a cup 12 of flexible material to which it is secured by a nut 13 engaging a threaded extremity 14 (FIG. 2) of that handle.

Figure 2:
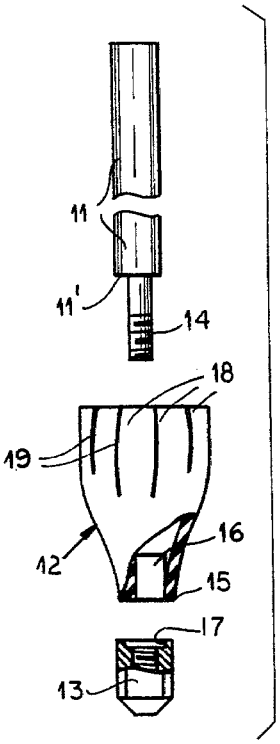
FIG. 2 is an exploded elevational view of the implement shown in FIG. 1.
Figure 3:
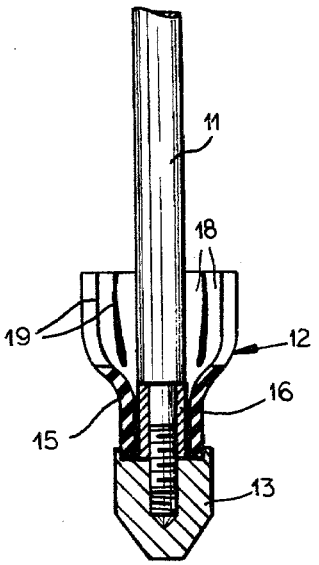
FIG. 3 is a sectional view of the lower part of the assembled implement.

As seen in FIGS. 2 and 3, cup 12 is formed at its bottom with a tubular neck 15 tightly embracing a metallic ferrule 16 which may be cemented or otherwise fastened thereto. Nut 13 has an annular recess 17 which forms a seat for ferrule 16 and for the lower end of neck 15 whose upper end comes to rest against an annular shoulder 11' of rod 11 when extremity 14 thereof is screwed into the nut.

Cup 12 is divided into a plurality of petal-shaped leaves 18 by slits 19 which extend down from its rim but terminate well above neck 15. When the cup is pushed down into the water-filled pipe 23, leaves 18 readily yield inward to let the water pass around the cup which therefore can be lowered against limited resistance even if the drain is completely clogged by the obstruction 25. On its upward stroke, however, cup 12 closely hugs the inner wall surface of pipe 23 as the body of water in its interior deforms the leaves 18 outwardly and slightly spreads them apart as they slide along that surface. Thus, virtually the entire column of water above the cup 12 is lifted to create suction in gooseneck 24 which reverses the compaction experienced by the lump under the water pressure previously applied thereto. As a result, the lump generally disintegrates quite rapidly and lets the water run off into the sewer as soon as the cup reaches the level of drain 21. If necessary, the pumping action may be repeated.

If the pipe 23 is only partly filled when the cup is initially lowered, additonal water should be poured in to spread the leaves in the aforedescribed manner before the handle 11 is raised again.

The cup 12 is advantageously made of polyethylene or nylon, though less elastic polymeric materials such as styrofoam will also work.

I claim:

1. An implement for dislodging a lump of matter obstructing a drainpipe, comprising an elongate handle and an upwardly open cup secured to the lower end of said handle, said cup being provided with slits extending from an upper rim down and dividing the periphery thereof into a plurality of petal-shaped leaves which are sufficiently flexible to yield inward when the cup is thrust down a water-filled pipe whose inner diameter substantially equals the outer diameter of the cup at said rim, said leaves tending to diverge upwardly while hugging the pipe wall under the weight of the water accumulated therein when the cup is being pulled up with creation of suction therebelow in said pipe.

2. An implement as defined in claim 1 wherein said cup has a bottom opening bounded by a tubular neck receiving a lower extremity of said handle.

3. An implement as defined in claim 2 wherein said lower extremity is threaded, further comprising a nut screwed onto said lower extremity below said neck.

4. An implement as defined in claim 3, further comprising a metallic ferrule firmly held in said neck and projecting upwardly therefrom while surrounding said lower extremity, said handle having an annular shoulder overhanging said ferrule and clamping same between itself and said nut.

5. An implement as defined in claim 4 wherein said nut has an annular recess forming a seat for the lower end of said neck.

* * * * *